United States Patent [19]

Stockham

[11] Patent Number: 5,056,982

[45] Date of Patent: Oct. 15, 1991

[54] APPARATUS TO FACILITATE THE HANDLING OF LARGE ROLLS OF PAPER STOCK OR SIMILAR MATERIAL

[75] Inventor: Brian W. Stockham, Canyon Country, Calif.

[73] Assignee: GTE Data Services Incorporated, Tampa, Fla.

[21] Appl. No.: 261,536

[22] Filed: Oct. 24, 1988

[51] Int. Cl.[5] ..... B66F 9/06

[52] U.S. Cl. ..... 414/607; 414/911; 294/104; 242/86.5 R

[58] Field of Search ..... 414/607, 608, 621, 908, 414/910, 911; 242/86.5 R; 294/104, 82.31, 82.34

[56] References Cited

U.S. PATENT DOCUMENTS

| | | | |
|---|---|---|---|
| 3,237,797 | 3/1966 | French et al. | 414/607 X |
| 3,510,019 | 5/1970 | Howard | 414/607 |
| 3,820,673 | 6/1974 | McVaugh | 414/911 X |
| 3,911,671 | 10/1975 | Guillen | 294/82.34 X |
| 4,073,175 | 2/1978 | Seamon | 414/607 X |
| 4,365,768 | 12/1982 | Woodruff | 414/607 X |
| 4,385,860 | 5/1983 | Corbin | 414/607 X |
| 4,657,469 | 4/1987 | Beierle et al. | 414/607 |
| 4,693,164 | 9/1887 | Grinwald | 294/82.31 X |
| 4,762,291 | 4/1988 | Sauber | 414/911 X |
| 4,796,826 | 1/1989 | Pierce | 242/85,5 R |
| 4,822,089 | 4/1989 | Moore et al. | 294/82.34 |

FOREIGN PATENT DOCUMENTS

| | | | |
|---|---|---|---|
| 581083 | 11/1977 | U.S.S.R. | 414/911 |
| 2106553 | 4/1983 | United Kingdom | 414/911 |

*Primary Examiner*—David A. Bucci

*Attorney, Agent, or Firm*—John A. Odozynski

[57] ABSTRACT

Apparatus to facilitate the handling of large rolls of paper stock or similar material consisting of two clamping fixtures adapted to be mounted on the tines of a forklift truck and a shaft that passes through the center of large rolls of paper stock or similar material and is also passed through the clamping fixtures, the apparatus facilitating handling of the rolls by the forklift truck. Each of the clamping fixtures includes a sleeve conforming to the profile of a fork tine, a clamping bracket affixed to the sleeve, and a bottom lock bolt for securing the sleeve to a fork tine at an adjustable position on the fork tine.

6 Claims, 2 Drawing Sheets

APPARATUS TO FACILITATE THE HANDLING OF LARGE ROLLS OF PAPER STOCK OR SIMILAR MATERIAL

BACKGROUND OF THE INVENTION

1. Field of the Invention

This application relates to material handling and, more particularly, to apparatus handling large rolls of paper stock or similar material.

2. Related Art

The handling of large rolls of paper stock or similar material can be exceedingly difficult because of the size, weight and the round configuration of the rolls. As a result, the rolls, if not properly controlled, are disposed by their weight to roll away when placed on a surface offering even a modest incline.

For example, large rolls of paper, approximately five feet in diameter and weighing approximately 860 pounds each, are utilized in connection with a feed device, called "Lasermax," that feeds the rolls of paper stock into a laser printer such as the IBM 3800. In the past, these rolls have been transported by means of an electric pallet jack. In this arrangement, a pallet, to which two rolls of the aforementioned paper stock have been strapped, is moved from one location to another by means of the electric pallet jack. Once the rolls arrive at the proper location adjacent the intended Lasermax machine, the strapping is removed. The rolls must then be manually rolled off the pallet and loaded into the Lasermax machine.

In at least one instance where this technique was employed, a roll broke loose from its pallet and rolled down an associated ramp, literally moving a wall on impact and causing acoustic tile on the ceiling of the room in which the mishap occurred to fall.

On another occasion, a roll tipped over on its side while being rolled off a pallet so that it became virtually impossible to right the roll in place in the proper condition.

It should be apparent that there is a significant potential for serious personal injury, as well as property damage, associated with existing techniques for handling such material rolls. Accordingly, it is an object of the present invention to provide a new and enhanced technique for transporting large rolls of paper stock. The apparatus for employing such technique should be substantially safer and more efficient than the techniques employed heretofore.

SUMMARY OF THE INVENTION

According to the present invention, a straddle truck, sometimes referred to as a forklift truck, is employed and adapted, by the addition of certain apparatus in accordance with the present invention, to facilitate the movement of large rolls of paper and similar stock. The enabling apparatus includes two clamping fixtures that are designed to be adjustably positioned along the lengths of the tines of the forklift truck so as to readily accommodate various sizes of paper or similar material rolls. Each of the two clamping fixtures is equipped with a sleeve adapted to the profile of the tines so as to surround the tines of the fork. A clamping bracket is attached to an upper surface of the sleeve, disposed parallel to the sleeve. The clamping fixture assembly is configured to receive a center bar, or shaft, that has been placed through the center of the paper rolls. A cam-clamp locking lever on each of the clamping fixtures then secures the shaft. The sleeve portion, in turn, operates with a bottom lock bolt to secure the clamping fixture to the tine.

It can thus be seen that with two such clamping fixtures attached to the tines of the forklift truck, the shaft can be positioned in the upper portion of each, thereby forming an axle which is adapted to pass through the center of the paper stock rolls. In this manner, once so positioned through the paper stock rolls and locked into position on the forklift truck, the fork can be elevated, and the entire assembly moved to the desired location.

In practice, the two clamping fixtures may be variably positioned along the length of the fork so that the radius of the roll of paper stock to be handled will clear the rear portion of the fork. After the clamping fixtures have been positioned, the entire forklift truck moves in and straddles the pallet on which the paper stock is located. Any strapping material which has held the rolls to the pallet is then removed, and the shaft is then disengaged from its location on the side of the forklift truck (where it is retained when not being used) and placed first through a collinear opening of the first clamping fixture, then through the opening in the center of the paper rolls and on then through the clamping fixture on the far side. The cam-clamp locking levers are then moved forward, and the safety latches are inserted, insuring the proper securing of the shaft. The above-described process assumes that the clamping brackets have been raised to a location approximately in line with the openings in the center of each roll of paper stock. The locking cam-clamp levers lock the shaft in place to the two brackets, which have similarly been locked by the sleeve and the bottom lock bolt to the forklift truck itself.

As a preferred alternative to the above-described operation, however, the shaft may first be disengaged from the forklift truck and axially inserted lengthwise through the opening in the interior of the roll of paper stock. The forklift truck, with clamping fixtures attached, is then driven in the direction of the roll and the inserted shaft. Engagement of the cam-clamp levers with the shaft causes the levers to open—that is, pivot upwardly—so as to permit entry of the shaft into a throat-like opening in the clamping fixture. Further forward movement of the forklift truck causes the cam-clamp levers to drop down into a closed position, surrounding the shaft. As before, the safety latches are then inserted so as to properly secure the shaft.

The operator then raises the fork, lifting the rolls of paper off the associated pallet to which they had been previously strapped. The pallet is then manually moved out of the way, and the operator then moves the entire assembly, including the rolls of paper stock, to a location directly adjacent to the Lasermax machine that is utilized to feed the paper into the IBM 3800 laser printer. With the arrangement shown, movement of the paper stock roll to a position nearly contiguous to the Lasermax printer becomes relatively simple. With the roll so positioned, the shaft can be removed from the clamping brackets by removing the safety latches from the cam-clamp locking levers and then releasing the levers so that the shaft is no longer retained therein. This occurs, of course, after the forklift has been lowered to place the roll at floor level. The cam-clamp locking lever has, in fact, been designed so that it will not release the roll until the roll is at floor level.

With the shaft removed, the roll can then be manually moved into place in the Lasermax machine and the forklift truck and the associated apparatus withdrawn.

DESCRIPTION OF THE PREFERRED EMBODIMENT

For a better understanding of the subject invention, reference is made to the following Description and appended Claims, in conjunction with the above-described Drawings.

Figure 1:
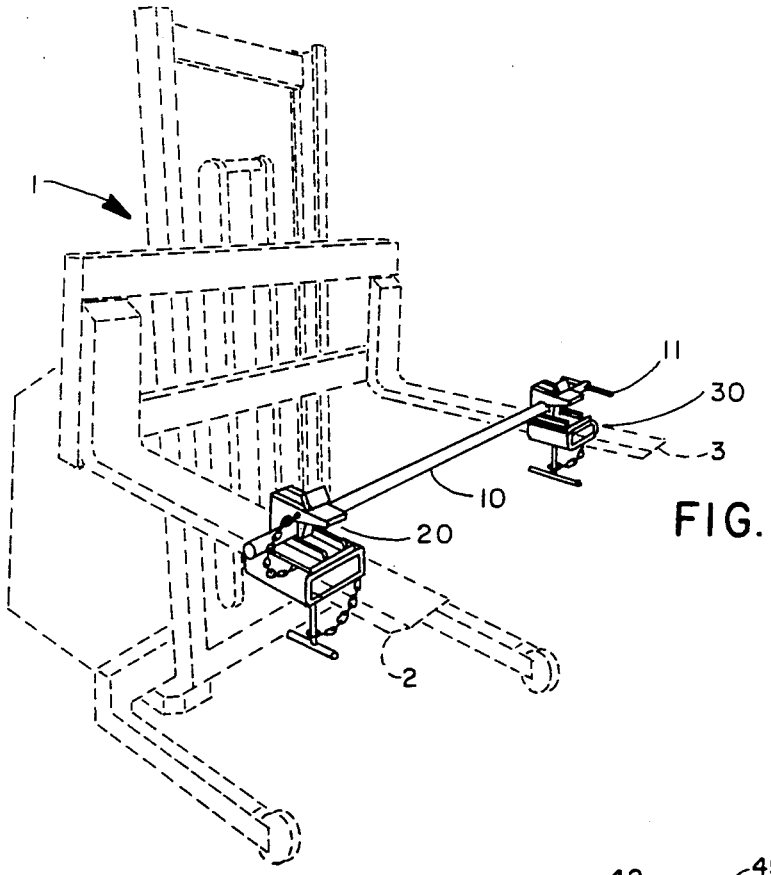
FIG. 1 is a perspective view of a forklift or straddle truck drawn in phantom with two clamping brackets and an associated shaft shown in their approximately correct position on the forklift.

Referring now to FIG. 1, apparatus in accordance with the present invention is shown to comprise a shaft 10 surrounded at opposite ends by two clamping fixtures 20 and 30, each of which fixtures is located on one of the tines 2 and 3 of an associated forklift truck 1. The forklift truck is shown in phantom inasmuch as the forklift itself does not represent a component of the present invention. The clamping fixtures 20 and 30 are mutually identical in construction. The details of the clamping fixtures are shown in FIGS. 2 and 3.

Figure 2:
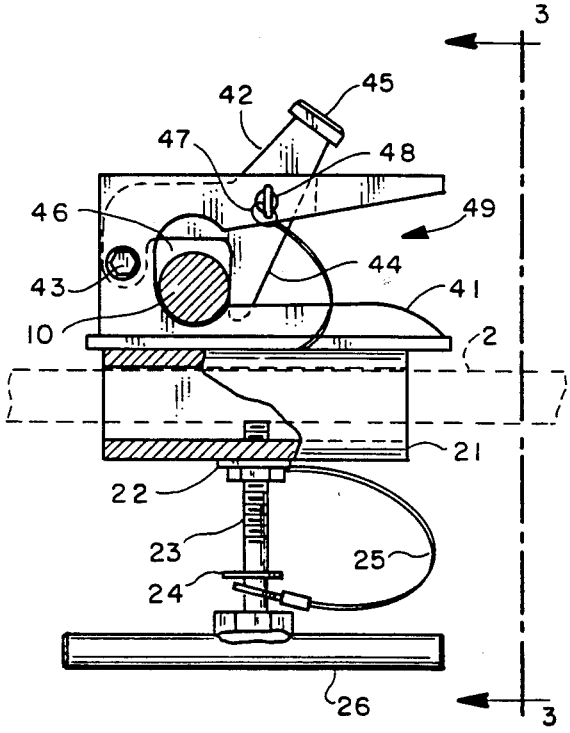
FIG. 2 is a partially sectionalized side view of the clamping bracket and shaft that comprise a portion of the apparatus of the present invention.
Figure 3:
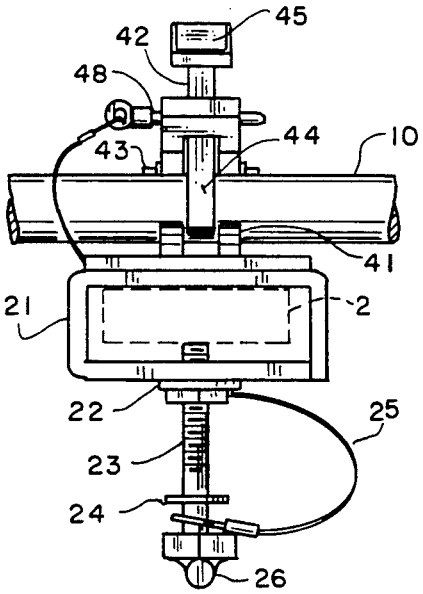
FIG. 3 is a front view shown along section line 3—3 of FIG. 2, showing a clamping bracket in accordance with the present invention.

Referring now to FIGS. 2 and 3, each of the clamping fixtures is shown to include a rectangular sleeve portion 21 in position over a tine, such as tine 2, of an associated forklift truck. Sleeve 21 is shown to exhibit a rectangular cross section, conforming to the profile of tine 2. The sleeve, of course, is susceptible of modification so as to conform to tines of other configurations.

Once positioned on the tine, handle 26 is utilized to rotate bottom lock bolt 23, thereby advancing the lock bolt through a threaded portion 22 that is affixed to sleeve 21. The lock bolt is advanced until it makes contact with tine 2 or tine 3 (not shown), securely fastening clamping fixture 20 to the associated tine of the forklift truck 1. To prevent loss of the lock bolt 23, a chain 25 provides a permanent but flexible connection between lock bolt 23 and sleeve 21. A washer 24 is securely fastened to lock bolt 23 so that chain 25 is permanently and rotatably retained between washer 24 and handle 26 on bolt 23.

Affixed to the top of sleeve 21 is a clamping bracket that includes a cam-clamp locking lever and associated support mechanism in the form of frame 41. Frame 41 has a throat-like opening 49 therein, terminating in the shaft-receiving portion 46. Positioned internal to the frame 41 is the cam-clamp locking lever 42 which is able to pivot about pivot point 43. To facilitate grasping the locking lever, the lever includes an integral handle portion 45 disposed on one end thereof. When the lever is pivoted into the forward, or closed, position, an opening 47 extends collinearly through the frame 41 and through the locking lever 42. This opening accommodates the insertion of a safety latch or pin 48 (otherwise connected to the base by means of a piece of short cable) which, when inserted, prevents opening of the cam-clamp locking lever 42. As can be readily seen, when the locking lever is in its open position, a shaft can be introduced into the throat of the frame portion 41, ultimately residing in shaft-receiving portion 46. With the shaft in this position, lever 42 can be operated so as to position end portion 44 into contact with the shaft and maintain the shaft in proper position upon the insertion of the safety latch.

As noted above, when the two clamping fixtures 20 and 30 are properly located on tines 2 and 3 of forklift truck 1, shaft 10 will be positioned in each throat of a respective frame 41. With the shaft so positioned, the cam-clamp locking levers are pivotally positioned into the closed direction for retention of the shaft within the clamping brackets. The safety latches 48 are then inserted into openings 47 in order to retain the locking lever in the proper position, thoroughly locking shaft 10 into position.

It can be seen from the above apparatus that large rolls of paper stock or similar material can be mounted on shaft 10 and then, by means of elevation of the forklift truck, moved from place to place.

Figure 4:
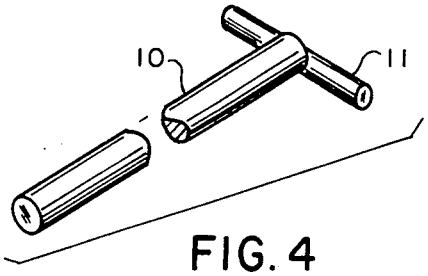
FIG. 4 is a broken perspective view of the shaft utilized as a portion of the apparatus of the present invention.
Figure 5:
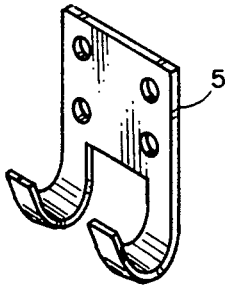
FIG. 5 is a bracket adapted for mounting on a forklift truck and further adapted to hold the shaft utilized in the present invention when said shaft is not in use.

The shaft 10, with its associated handle 11, is shown in broken perspective in FIG. 4. The support bracket 5 that retains the handle 11 is shown in FIG. 5. This bracket 5 is adapted for mounting on the side of the forklift truck 1 in a manner similar to that shown in FIGS. 6A through 6D, inclusive.

Figure 6A:
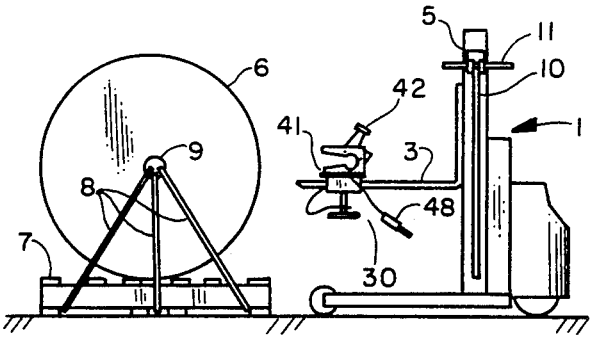
FIG. 6A is a side view depicting a forklift truck approaching a pallet containing one or more rolls of material stock such as paper, the forklift including apparatus in accordance with the present invention.
Figure 6B:
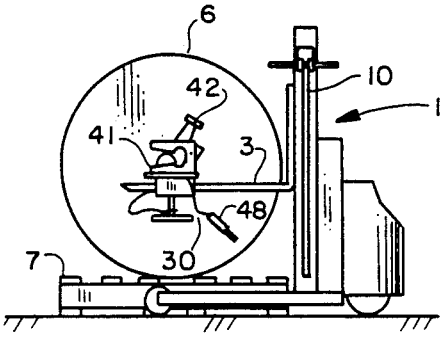
FIG. 6B is a side view of a forklift truck equipped with apparatus in accordance with the present invention straddling a pallet on which a roll of paper or similar sock is located, with the apparatus in accordance with the present invention positioned in proper location adjacent the centers of such rolls.
Figure 6C:
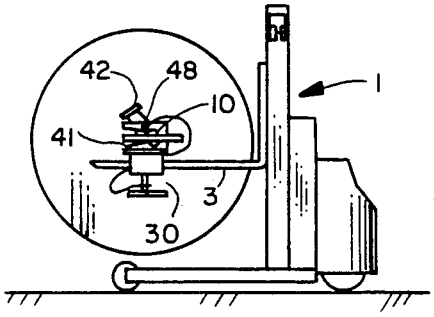
FIG. 6C is a side view of a forklift truck and a roll of paper stock with the shaft that forms a portion of the present invention placed in proper location through the clamping brackets of the present invention and also through the center of each roll of paper stock. The forklift is also shown in a slightly raised position, facilitating the removal of the pallet from beneath the paper roll on which it had been located.
Figure 6D:
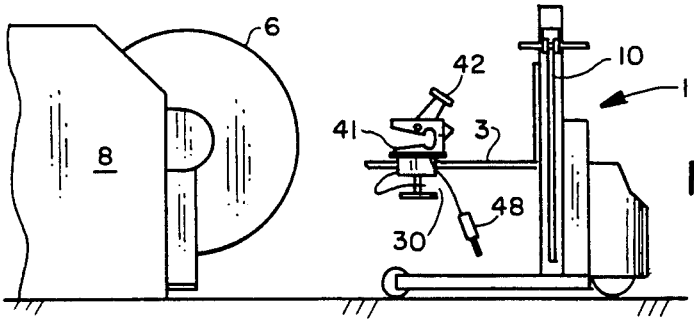
FIG. 6D is a side view of a Lasermax machine with the paper roll now in location therein and the forklift truck withdrawn with the shaft removed from its location through the clamping brackets in the center of the associated paper roll and resorted to its nonoperative position on the bracket located on the side of the forklift truck.

A more thorough understanding of the present invention will be had by taking the following description in connection with FIGS. 6A through 6D, wherein a forklift truck 1 is equipped with two clamping fixtures in accordance with the present invention, such as 30 and 20 (not shown). Initially, as shown in FIG. 6A, the forklift truck approaches one or more rolls of paper or similar stock located on a pallet 7 and secured thereto by means of straps 8. The forklift truck is advanced as shown in FIG. 6B, and the straps 8 are removed from pallet 7 so that paper rolls 6 rest solely on the pallet. The brackets are then positioned with the upper sleeve 41 in line with opening 9 that runs through the center of each roll of paper or similar stock, with the forklift lowered to the same elevation also as opening 9. At this time, the operator will remove shaft 10 from its location on the side of forklift truck 1 and position it through the frame 41 of bracket 30, thence through opening 9 and the center of the roll or rolls of paper or similar stock 6 and on through the frame 41 of clamping bracket 20 on the opposite side and not shown in FIG. 6B or 6C. After shaft 10 is in proper location, the cam-clamp locking levers 42 on both sides will be operated, and the safety latches 48 inserted to retain the shaft in proper position, locking it securely in position.

As a preferred alternative to the above-described operation, however, the shaft may first be detached from the forklift truck and axially inserted lengthwise through the axial opening running through the interior of the roll of paper stock. The forklift truck, with clamping fixtures attached, is then driven in the direction of the roll and the inserted shaft. Engagement of the cam-clamp levers with the shaft causes the levers to open—that is, pivot upwardly—so as to permit entry of the shaft into a throat-like opening 49. Further forward movement of the forklift truck causes the cam-clamp levers to drop down, surrounding the shaft. As before, the safety latches are then inserted so as to properly secure the shaft.

With the cam-clamp locking levers secured, the operator is able operate the forklift, raising the paper roll off its location on pallet 7. The pallet will be withdrawn from its location beneath the paper rolls and within the straddled base of forklift truck 1. The forklift truck is then be maneuvered to the desired location, presumably adjacent a Lasermax feed machine, such as 8. At the feed machine, the paper roll 6 will be lowered to the floor level, and shaft 10 will be withdrawn from the brackets. Obviously, cam-clamp locking lever 42 must also be released before the shaft can be withdrawn and repositioned on its bracket 5 along one side of the forklift unit. The operator can then withdraw the entire forklift truck, including brackets 30 and 20, and the paper roll can be positioned within the Lasermax machine as required.

In the aforementioned manner, control can be maintained over the heavy and bulky paper rolls or similar stock, thereby minimizing the likelihood that a roll might tip over while being rolled off a pallet to a waiting Lasermax machine.

In fact, this danger, inherent in existing methods of transporting paper stock, is further abated by its elimination of the need, altogether, for the use of a pallet.

It will be obvious to those possessing ordinary skill in the art that numerous modifications can be made to the present invention without departure from the spirit or scope of the present invention, which shall be limited only by the scope of the claims appended hereto.

What is claimed is:

1. An apparatus for transporting, via a forklift truck, an article that has an opening that accommodates the insertion of a shaft, the apparatus comprising, in combination:

(a) a pair of clamping fixtures for mounting on two fork tines of the forklift truck, each of the clamping fixtures for respective mounting on one of the fork tines and each respectively comprising:
  (i) a sleeve conforming to the profile of a fork tine,
  (ii) a clamping bracket having a frame affixed to the sleeve and a cam-clamp locking lever pivotally attached to the frame about a pivot point,
  (iii) means for securing the sleeve to a fork tine at an adjustable position n the fork tine, and
  (iv) safety latch means, coupled to said frame and said cam-clamp locking lever, for preventing pivotal movement of said locking lever to insure against inadvertent operation of said locking lever; and (b) a shaft for insertion through the clamping fixtures and through the opening of the article so as to secure the article to the forklift truck.

2. An apparatus as defined in claim 1 wherein the frame exhibits a throat-like opening (49) and a shaft-receiving portion (46) for the insertion and securing of the shaft.

3. An apparatus as defined in claim 2 wherein each of the clamping fixtures exhibits an opening (47) extending collinearly through the respective frame and respective cam-clamp locking lever when the cam-clamp locking lever is in a closed position.

4. An apparatus as defined in claim 3 wherein said safety latch means comprises a pin adapted for insertion into the respective collinearly extending opening (47).

5. An apparatus as defined in claim 4 wherein the means for securing the sleeve to a fork tine includes a bottom lock bolt (23).

6. An apparatus as defined in claim 5 wherein the bottom lock bolt is attached to the sleeve by a chain.

* * * * *